United States Patent [19]

Buse

[11] 4,039,419

[45] Aug. 2, 1977

[54] ANODE POSITIONING DEVICE

[75] Inventor: Kenneth E. Buse, Davenport, Iowa

[73] Assignee: Aluminum Company of America, Pittsburgh, Pa.

[21] Appl. No.: 708,289

[22] Filed: July 23, 1976

[51] Int. Cl.[2] ..... C25D 17/00; C25C 3/06; C25C 3/12

[52] U.S. Cl. ..... 204/225; 204/243 R; 204/245

[58] Field of Search ..... 204/67, 242, 243–247, 204/225; 254/98, 103; 74/89.15

[56] References Cited

U.S. PATENT DOCUMENTS

| | | | |
|---|---|---|---|
| 3,459,057 | 8/1959 | Bonneric | 74/89.15 |
| 3,512,421 | 5/1970 | Anderson | 74/89.15 |
| 3,761,379 | 9/1973 | Elliott | 204/225 |
| 3,797,324 | 3/1974 | Sheesley et al. | 74/89.15 |

FOREIGN PATENT DOCUMENTS

| | | | |
|---|---|---|---|
| 1,328,361 | 1/1963 | France | 204/225 |
| 321,472 | 1/1972 | U.S.S.R. | 204/225 |

*Primary Examiner*—John H. Mack
*Assistant Examiner*—D. R. Valentine
*Attorney, Agent, or Firm*—William J. O'Rourke, Jr.

[57] ABSTRACT

A positioning device is disclosed comprising a jack screw having a stationary guide housing, an externally helically threaded shaft through the housing and a retainer threadably engaged onto the shaft, and a rotatable ratchet having a head mounted on a top portion of the shaft. The positioning device further comprises at least one fluid cylinder and a piston fitting inside a mating chamber in the cylinder, a piston rod extending from the piston and connected to the ratchet and means for reciprocally driving the piston in the chamber. Each stroke of the piston and attached piston rod displaces the ratchet arm rotating the ratchet head and the shaft connected thereto, thereby displacing the retainer along the shaft.

4 Claims, 4 Drawing Figures

ANODE POSITIONING DEVICE

BACKGROUND OF THE INVENTION

1. Field of Invention

The present invention relates to a positioning device and more particularly to an improved device for incrementally positioning at least one anode relative to the cathode of an electrolytic cell.

2. Description of the Prior Art

Electrolytic cells or pots, such as those used in the production of aluminum, basically consist of a carbon lined steel tank or vessel containing molten cryolite in which alumina is dissolved. Metallic aluminum is separated from the oxide (alumina) by passing an electric current through the solution at a temperature of approximately 970° C (1775° F). Carbon electrodes, or anodes, are suspended above each electrolytic pot. The depth of immersion of the anode in the electrolyte is adjustable and is carefully controlled. Usually, the anodes extend into the bath to within about two inches of the molten metal. Direct current is led into the electrolyte through the anodees and out through cathodic collector bars imbedded in the carbon lining.

In the reduction process, the electrolyte is maintained in a molten state and at a proper temperature by the heating action of the electric current passing through it from the anodes to the cathode. The anode-cathode distance should be frequently adjusted to maintain the desired bath temperature of about 960°-980° C (1760°-1796° F). Sufficient heat is lost at the surface of the electrolyte such that a frozen insulating crust, usually from 1 to 2 inches thick, forms at the top of the bath and around the anodes.

As the aluminum is electrolytically separated, oxygen is liberated at the carbon anode where it forms carbon dioxide while consuming the carbon anodes. As the carbon anodes are consumed, molten metal builds up in the bottom of the pot and the anodes must be adjusted periodically to assure a narrow spacing which maintains the voltage close to the decomposition voltage of the electrolyte. Proper frequent adjustment of the anode position will increase the efficiency of the electrolytic pot resulting in increasing production, reducing electricity requirements per pound of metal, reducing the rate of consumption of carbon anodes and reducing the possibility of short circuiting with associated problems.

To illustrate the present electrical inefficiency, a current of 1000 amp should deposit approximately 0.74 pound of aluminum per hour at 100% current efficiency. For various reasons, the best commercial current efficiency is about 90%. The theoretical voltage required for the decomposition of the alumina with a carbon anode is a little less than 2 volts; the actual voltage at the cell terminals is 4.5 to 7.0 volts. One way to reduce this inefficiency is to maintain a more accurate anode-cathode distance.

Electric motors such as those disclosed in U.S. Pat. No. 3,844,913 are presently used to position anodes. It has been found that the response of the present electric motors to a signal is highly variable, in part, because of the varying resistance to anode movement imparted by the frozen bath crust which has formed around the anode in the reduction pot. This crust can put a load in excess of 10,000 pounds on the anode and cause the motor to stall or become overloaded. To illustrate further, in a computerized reduction system, such as those disclosed in U.S. Pat. Nos. 3,627,666 and 3,900,373, each anode in the pot line may be consecutively surveyed to determine its proper position. The survey may determine that a specific anode should now be lowered 0.120 inch. If the electric motor takes 1.0 second to move the anode 0.040 inch, a 3.0 second timed pulse is sent to the electric motor. Under ideal conditions the anode would be lowered 0.120 inch and the computer would record this adjustment accordingly. However, in actual operation the crust may have imparted such a load on the anode that a 3.0 second timed pulse sent to the motor caused the anode to be lowered less than 0.120 inch, or possibly not be lowered at all. Therefore, although the proper position of the anode is accurately determined, and the correct time pulse is sent to the electric jack motor, there is no assurance that the anode has responded accordingly. The anode-cathode distance will be inaccurately adjusted, and this error will not be discovered until that specific anode is surveyed again, whereupon the anode may repeatedly be inaccurately positioned.

Also, there is an inherent safety hazard associated with the operation of three phase alternating current induction motors installed in a smelting pot which may be at a potential from zero to almost one thousand direct current volts relative to ground potential. This two voltage level condition creates a risk of injury or death to the operators.

Accordingly, an improved positioning device is required which will assure that an anode to be positioned in an electrolytic pot accurately responds to positioning commands to assure more precise control of the reduction process. Also, it would be beneficial if the employment of the improved positioning device would utilize nonelectrical-conducting lines to eliminate the present two levels of voltage in the reduction pot.

SUMMARY OF THE INVENTION

This invention may be summarized as providing an improved anode positioning device for precisely displacing the anodes comprising a jack screw having a stationary guide housing and an externally helically threaded shaft through the housing, a retainer threadably engaged onto the shaft and a rotatable ratchet having a head mounted on the top portion of the shaft. The positioning device further comprises at least one fluid cylinder and a piston fitting inside a mating chamber in the cylinder, a piston rod extending from the piston and connected to the ratchet, and means for reciprocally driving the piston in the chamber. Each stroke of the piston and the corresponding piston rod displaces the ratchet arm rotating the ratchet head and the shaft connected thereto, thereby displacing the retainer along the shaft.

The ratchet head of the improved positioning device of the subject invention may also be provided with a dual position switch, whereby turning the position of the switch will change the direction in which the ratchet teeth engage the pawl to turn the jack screw shaft, thereby permitting selective displacement of the anode either toward or away from the electrolytic cell cathode. Further, the dual position switch may be operated by a second fluid cylinder having a piston rod connected to the switch.

Among the advantages of the subject invention is the provision of a new and improved positioning device which will accurately respond to positioning commands and a computer or other similar counter may record the number of full thrusts of a piston in a fluid cylinder chamber rather than record the conventional timed pulse.

This invention also provides an improved anode positioning device for accurately positioning at least one anode toward or away from an electrolyte bath in an electrolytic cell to assure more precise control of the reduction process.

Another advantage of this invention is the provision of a positioning device that can be readily adapted to position anodes in existing electrolytic cells.

It follows that the positioning device of the present invention, when utilized to position anodes in an electrolytic cell, will result in a more economically efficient and productive operation.

It also follows that an objective of this invention is the provision of an improved anode positioning device for an electrolytic cell which utilizes nonelectrical-conducting lines to eliminate the present hazard due to two levels of voltage in the reduction pot.

The above and other objects and advantages of this invention will be more fully understood and appreciated with reference to the following description and the drawings appended hereto.

DESCRIPTION OF THE PREFERRED EMBODIMENTS

Figure 1:
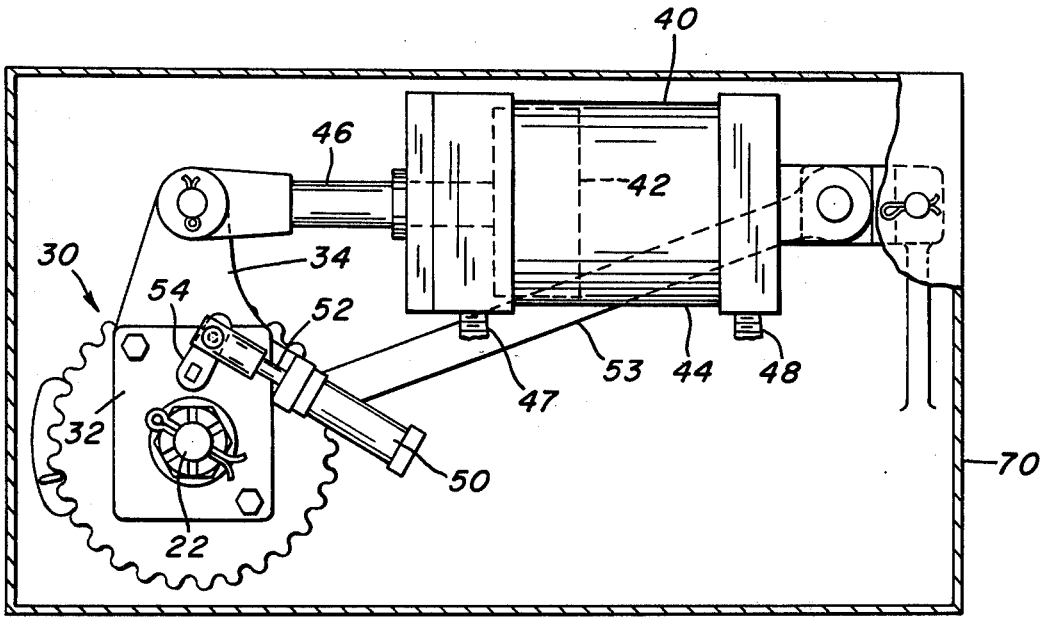
FIG. 1 is a top plan view of a positioning device of the present invention.
Figure 2:
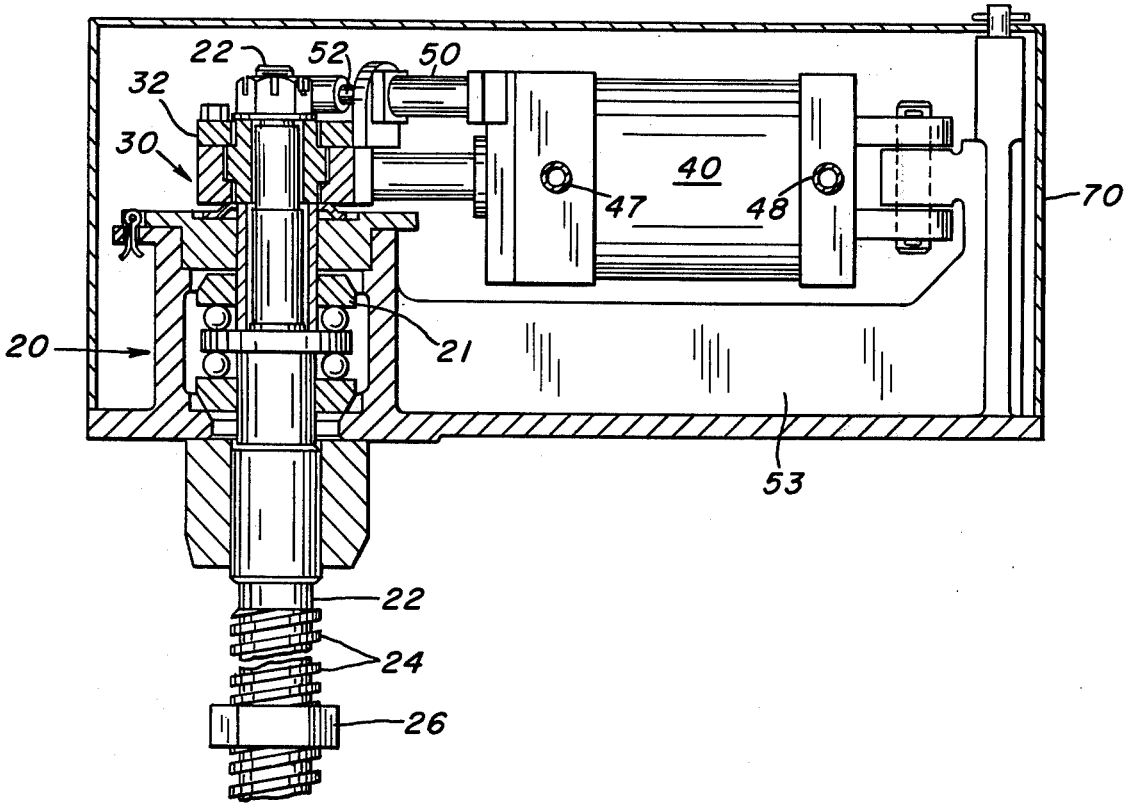
FIG. 2 is a partial cross sectional view of the positioning device shown in FIG. 1.

Referring particularly to the drawins, FIGS. 1 and 2 illustrate a positioning device of this invention. The device includes a jack screw having a stationary guide housing 20 which may be provided with grooved ball, double direction thrust bearings 21 therein. An upper portion of a shaft 22 extends through the housing 20. On the exterior surface at the bottom portion of the shaft 22 are helical threads 24. A retainer, such as a nut 26, is threadably engaged onto the bottom portion of the shaft 22. An anode, or electrode, (not shown) may be attached by known means to the retainer 26 at the bottom of the jack screw shaft 22.

The positioning device also includes a ratchet 30 having a head 32 attached at the top portion of the jack screw shaft 22. The ratchet 30 has an arm 34 extending from the ratchet head 32. The device further includes a fluid cylinder 40 having a piston 42 fitting inside a mating cylindrical chamber 44. The term fluid cylinder is used herein to encompass both pneumatic and hydraulic cylinders. Extending from the piston 42 is a piston rod 46 the end of which is attached to the ratchet arm 34. It should be understood by those skilled in the art that more than one rod lying in more than one direction may be used to construct a ratchet arm 34 of the present invention. Air or hydraulic lines 47 and 48 are provided on each end of the fluid cylinder 40.

In a preferred embodiment of this invention, the positioning device includes a second fluid cylinder 50 having a piston rod 52 attached to a dual position switch 54 on the ratchet head 32. Both cylinders 40 and 50 are preferably operated by air or oil supplied through nonelectrical-conducting lines, such as air or hydraulic lines.

To assure efficient operation of the positioning device of the present invention the cylinders 40 and 50 and the guide housing 20 should be held firmly in place with respect to one another by, for example, a rigid arm 53. Firmly anchoring the cylinders 40 and 50, the guide housing 20, and the piston 42, operating at a relatively high rate of speed, will minimize vibration which could otherwise cause the device to malfunction.

In the operation of a computerized reduction process, such as those disclosed in U.S. Pat. Nos. 3,627,666 and 3,900,373, the proper or optimum position of each anode is determined. The actual position of the anode is compared with the optimum position, and initial determination is whether the anode should be raised or lowered. This signal is transmitted to the selective displacement switch 54 on the ratchet head 32. The switch 54 has only two positions which indicate either upward or downward direction for the anode, i.e. away from or toward the cathode, respectively. When the switch 54 is in position the ratchet head 32 is rotated in one direction either clockwise or counterclockwise and will remain stationary or idle when the ratchet arm 34 moves in the opposite direction. If the switch 54 is not in the proper position to move the anode in the desired direction, a fluid such as air is fed into the cylinder 50 to either advance or retract the piston rod 52 and thereby correctly position the switch 54 connected thereto, thus inserting the correct pawl in the ratchet head.

Figure 3:
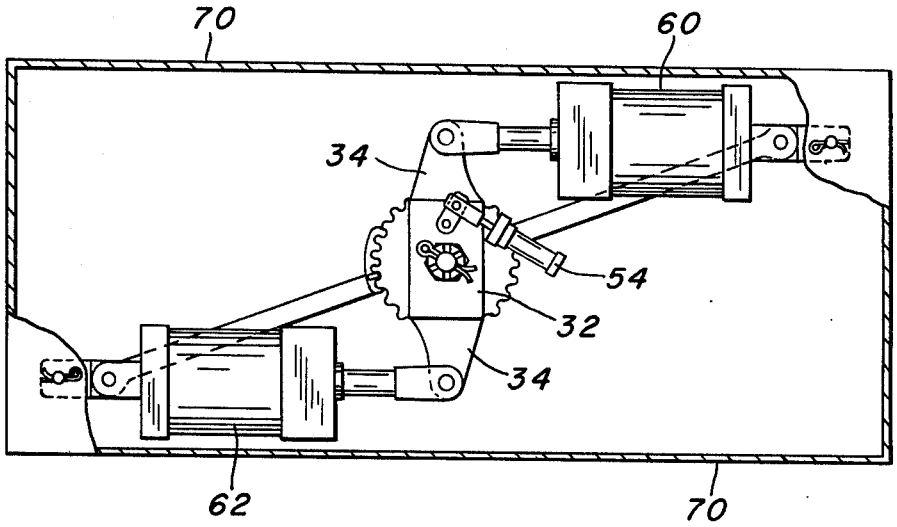
FIG. 3 is a top plan view of an alternative embodiment of a positioning device of the present invention.

In an alternative embodiment of the present invention, as shown in FIG. 3, the ratchet head 32 may be rotated in one direction by a first fluid cylinder 60 and in the other direction by a second fluid cylinder 62. This embodiment may be utilized with or without the dual position switch 54 described immediately above. In this embodiment both cylinders could be operated concurrently to distribute the load and force required to rotate the ratchet head in either direction.

The next step prior to the operation of the positioning device is to determine the vertical distance that the anode should be displaced and to convert that distance to the number of ratchet strokes required. This differs from the prior art which would convert the vertical distance to a timed pulse for which an electric motor must operate. In a preferred embodiment of this invention the fluid cylinder 40 has a four inch bore and imparts a three inch stroke on the piston 42 and the piston rod 46. The cylinder 40 preferably can be operated in the range of approximately 120 to 160 cycles per minute to insure that positioning adjustments are made quickly.

Each thrust of the preferred piston rod 46 described above, moves the ratchet arm 34 3 inches and thereby rotates the ratchet head 32 and the jack screw shaft 22 thirty degrees around the circumference. Rotation of the jack screw shaft 22 causes the nut 26 threadably engaged thereto and the anode attached to the nut 26 to be displaced. Preferably, each 30° movement of the ratchet arm 34 causes the nut 26 and the anode attached thereto to move 0.040 inch. It will be understood by those skilled in the art that the vertical displacement of the nut 26 will depend upon the spacing or pitch of the threads 24 on the exterior surface of the bottom portion of the shaft 22, the stroke distance of the piston rod 46, the length of the ratchet arm 34 and the number of teeth in the ratchet.

Figure 4:
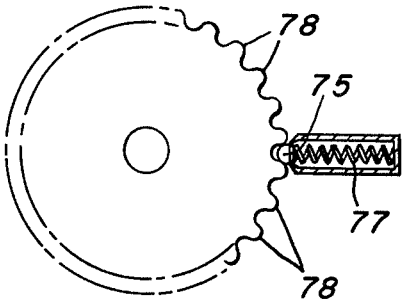
FIG. 4 is a cross-sectional view of an exemplary detent which may be used in the positioning device of the present invention.

In a preferred embodiment, the positioning device of the present invention is employed to move an anode in an electrolytic cell. In such an operation a crust, usually one to two inches thick, often forms around the anode and may impart a load in excess of 10,000 pounds on the anode. The prior art electric motors have been unable, at times, to overcome such resistance although erroneously indicating that the anode had actually been moved the necessary distance. The ratchet 30, when driven by a reciprocating fluid cylinder, will move and a computer or the like may accurately record each displacement only when the piston rod 46 completes each full stroke. To assure that the jack screw shaft 22 does not rotate freely when no load is on the shaft and the ratchet is on return stroke, a detent such as a pin or a catch in the ratchet teeth, can be provided as an alternative embodiment to hold the jack screw shaft 22 in position while the ratchet 34 is in return stroke. FIG. 4 illustrates a ball 75 biased by a spring 77 which acts as an exemplary detent to engage the teeth 78 and hold the shaft in position when the ratchet is idling in return stroke.

The importance of the operating speed of the fluid cylinder 40 is apparent when considering that each stroke of the piston rod 46 reciprocally drives the anode a slight distance, such as merely 0.040 inch, and the anodes must often be quickly positioned several inches at a time. One example of when the anodes must be lowered several inches occurs when the aluminum is drawn or tapped from the pot which drastically changes the metal and the bath levels. Another major adjustment occurs as the amount of alumina consumed in the operation of the pot drops to about 2% and an anode effect occurs notifying the operator to add more alumina. The anode effect causes the voltage in the pot to rise suddenly to 30 volts or more. When the anode effect occurs the anode may have to be quickly lowered approximately one inch. Also, each anode must also be raised as high as 18 inches in the event that a consumed anode must be changed and a new anode substituted in its place.

It should be apparent to those skilled in the art that if the present invention is employed to position anodes in an electrolytic pot a protective cover 70 should be provided around the cylinders 40 and 50, the guide housing 20, and the ratchet 30 to help shield and protect the positioning device from the ambient heat which may exceed 300° F as well as the abrasive alumina dust.

While it is apparent that the preferred embodiment of the device of the present invention is to position anodes in an electrolytic cell, it should be understood that the present device may also be utilized in a variety of other positioning applications, especially in cases where a load or resistance is imparted on the article being positioned.

Whereas the particular embodiments of this invention have been described above for purposes of illustration, it will be apparent to those skilled in the art that numerous variations of the details may be made without departing from the invention.

What is claimed is:

1. In an electrolytic cell having at least one anode adapted to be positioned toward an electrolytic bath, an anode positioning device for precisely displacing individual anodes comprising:

a jack screw having a stationary guide housing, an externally helically threaded shaft through said housing and a retainer threadably engaged onto said shaft and attached to the anode;

a ratchet having inner teeth adapted to engage a pawl and return a ratchet head mounted on a top portion of the jack screw shaft, and an arm integral with and connected to the ratchet head, said arm extending perpendicularly from the ratchet head with respect to the shaft;

a fluid cylinder firmly anchored to said housing having a piston fitting inside a mating chamber in said cylinder and a piston rod extending from said piston and connected to said ratchet arm with said ratchet arm fully responsive to piston rod movement;

means for reciprocally driving the piston in the chamber in said cylinder; and a detent device to hold said jack screw shaft in position while said ratchet arm and said piston rod connected thereto are stopped or in return stroke;

whereby each stroke of the piston and the attached piston rod displaces the ratchet arm a constant lateral distance, which rotates the ratchet head, and thus the jack screw shaft connected thereto, thereby displacing the retainer and the attached anode along the rotating shaft.

2. An anode positioning device as set forth in claim 1 in which said ratchet head is provided with a dual position switch to change the direction in which the ratchet teeth engage the pawl to turn the jack screw shaft, thereby permitting selective displacement of the anode either toward or away from said electrolytic bath.

3. An anode positioning device as set forth in claim 2 further comprising a second fluid cylinder for operating said dual position switch having a piston rod connected to the switch whereby outward extension of the piston rod allows the ratchet head to operate in one direction while inward extension of the piston rod allows the ratchet head to operate in the opposite direction.

4. An anode positioning device as set forth in claim 2 further comprising a second fluid cylinder having a piston and piston rod extending from said second piston and connected to said ratchet, and means for reciprocally driving the second piston inside a mating chamber in said cylinder whereby said first cylinder is utilized to rotate said ratchet head in one direction and second cylinder is utilized to rotate said ratchet head in the other direction.

* * * * *